US005548266A

United States Patent [19]

Murphy

[11] Patent Number: 5,548,266

[45] Date of Patent: Aug. 20, 1996

[54] THERMOSTAT CONSTRUCTION

[75] Inventor: Mark A. Murphy, Franklin, Tenn.

[73] Assignee: Apcom, Inc., Franklin, Tenn.

[21] Appl. No.: 303,298

[22] Filed: Sep. 8, 1994

[51] Int. Cl.[6] ..... H01H 37/12; H01H 37/54; H01H 37/52

[52] U.S. Cl. ..... 337/360; 337/347; 337/368; 337/349

[58] Field of Search ..... 337/319, 323, 337/347, 357, 360, 361, 368, 374, 375, 392, 400, 342, 343

[56] References Cited

U.S. PATENT DOCUMENTS

| | | | |
|---|---|---|---|
| 3,423,713 | 1/1969 | Levinn | 337/368 |
| 3,768,057 | 10/1973 | Sekira | 337/375 |
| 3,832,667 | 8/1974 | Blanton | 337/368 |
| 3,870,229 | 3/1975 | Manecke | 337/347 |
| 3,913,048 | 10/1975 | Mertler | 337/361 |
| 4,317,100 | 2/1982 | Boulanger | 337/347 |
| 4,365,228 | 12/1982 | Rowley | 337/347 |
| 4,720,696 | 1/1988 | Oldani | 337/347 |

*Primary Examiner*—Leo P. Picard
*Assistant Examiner*—Stephen T. Ryan
*Attorney, Agent, or Firm*—Paul R. Puerner

[57] ABSTRACT

A thermostatic switch construction including a housing having a switch arm mounted for movement inside. A bi-metallic snap disk is mounted in the housing and movable in response to temperature change with snap action between two positions of stability. A switch arm actuating plunger is slidably mounted in the housing with its lower end adapted for contact by and snap movement by the bi-metallic snap disk. A creep gap assembly is provided which includes a creep gap screw threadably mounted in the switch arm opposite the upper end of the plunger. Axes of the plunger and the gap set screw are in alignment. The creep space between the lower end of the set screw and the upper end of the plunger is adjustable by rotation of the set screw. A temperature setting adjustment is provided which includes a spring member mounted in the housing with one end of the spring member in direct contact with the bi-metallic snap disk to thereby exert pressure on the disk. An adjustment screw is threadably mounted in the housing with its end in contact with the spring member. The adjustment screw is operable when rotated to adjust the degree of pressure applied to the bi-metallic disk by the spring member. In the double throw embodiment of the invention, a first switch contact is mounted on a flexible support member and the second contact is mounted on the switch arm. The gap between the double throw contacts is adjustable by means of an adjustable screw member threaded into a stationary support opposite the first contact.

13 Claims, 3 Drawing Sheets

THERMOSTAT CONSTRUCTION

BACKGROUND OF THE INVENTION

This invention relates generally to bi-metallic snap disk thermostats in which means are provided to adjust the amount of creep gap between the snap disk actuator and the thermostatic switch arm. Current methods of manufacture involve measurement and grinding operations to attain proper creep gap. The creep gap setting means of the present invention provides a simpler and more accurate arrangement.

SUMMARY OF THE INVENTION

A thermostatic switch construction including a housing having a switch arm mounted for movement therein. A bi-metallic snap disk is mounted in the housing and movable with snap action between two positions of stability. A switch arm actuating plunger is slidably mounted in the housing and is adapted for snap movement by the snap disk. A creep gap set means is provided. Such means includes a creep gap set screw threadably mounted in the switch arm opposite one end of the plunger. The creep gap between the set screw and the end of the plunger is adjustable by rotation of the set screw. [A ]temperature setting adjustment is provided which includes a spring member mounted in the housing with one end of the spring member in direct contact with the bi-metallic snap disk to thereby exert pressure on the disk. An adjustment screw is threadably mounted in the housing with its end in contact with the spring member. The adjustment screw is operable when rotated to adjust the degree of pressure applied to the bi-metallic disk by the spring member. In the double throw embodiment of the invention, a first switch contact is mounted on a flexible support member and the second contact is mounted on the switch arm. The gap between the double throw contacts is adjustable by means of an adjustable screw member threaded into a stationary support opposite the first contact.

DESCRIPTION OF THE PREFERRED EMBODIMENT

Figure 1:
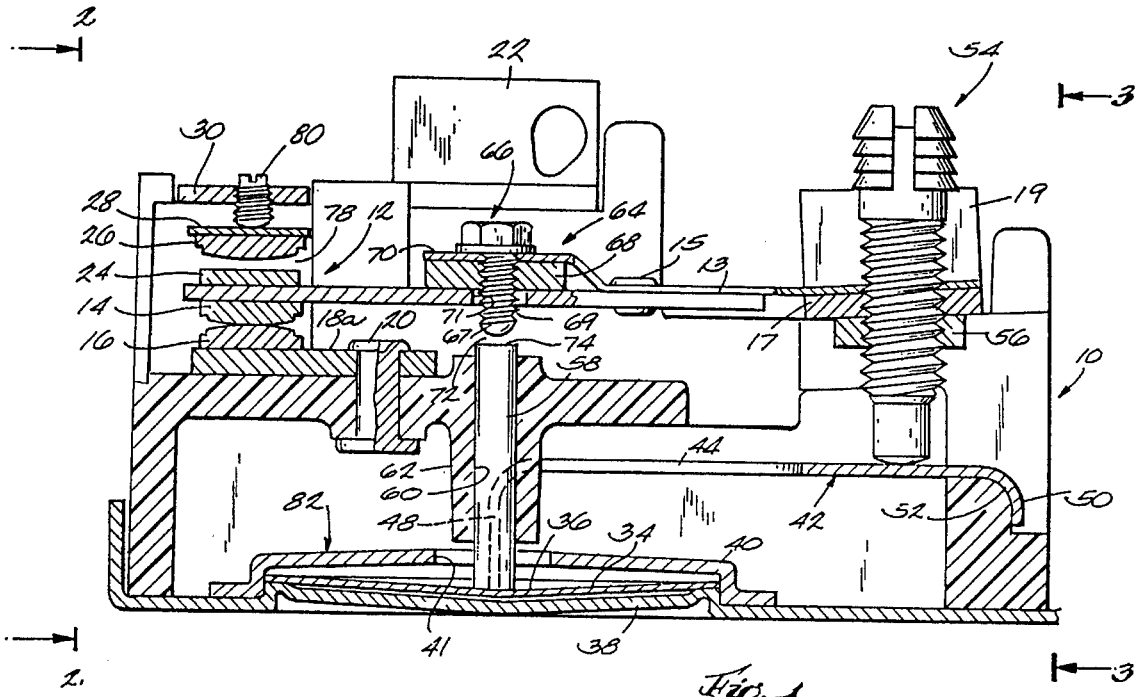
FIG. 1 is a side elevation view with parts broken away of the thermostatic switch of the present invention.
Figure 3:
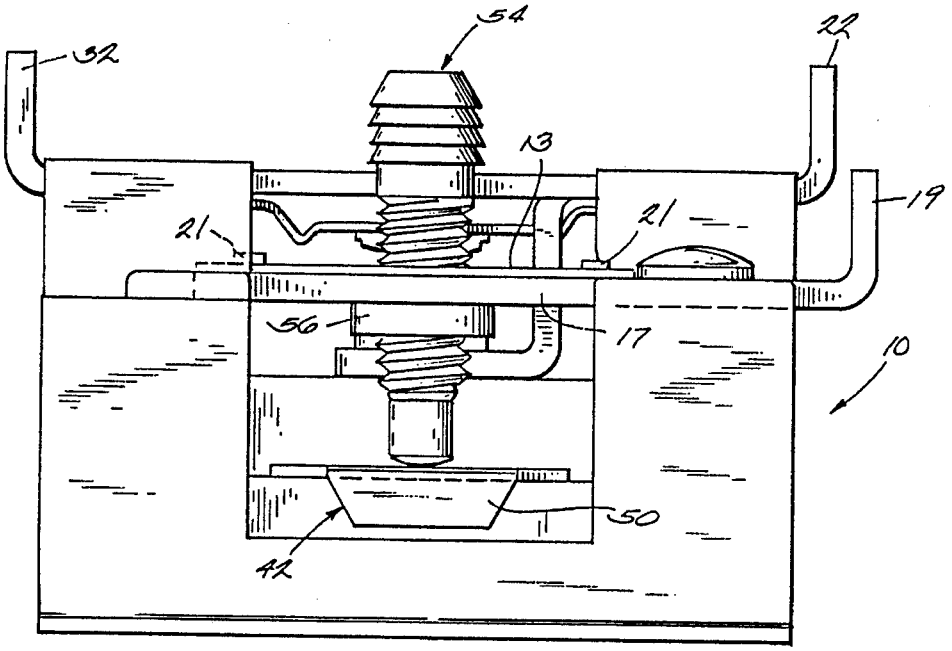
FIG. 3 is an end view of the switch construction shown in FIG. 1 taken along line 3—3 of FIG. 1.

Referring to FIG. 1, the thermostat construction of the present invention is comprised of a housing 10 of insulating material having a switch arm 12 mounted therein. Switch arm 12 is fastened to a spring arm 13 by a rivet 15. Spring arm 13 is fastened to the base portion 17 of a terminal fitting 19 by a pair of rivets 21 (see FIG. 3). The end of arm 12 (left hand end as viewed in FIG. 1) is free to move up and down and is biased downwardly by spring arm 13.

Figure 2:
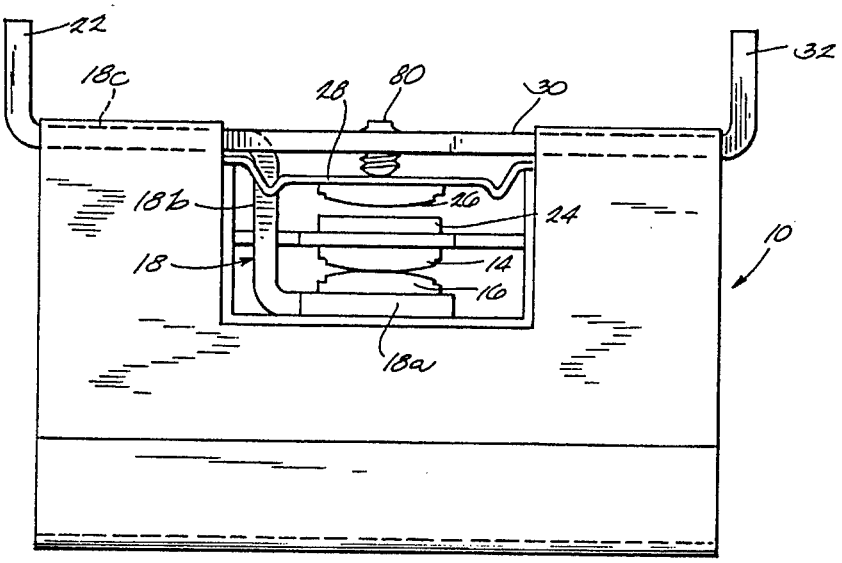
FIG. 2 is an end view of the switch construction shown in FIG. 1 taken along line 2—2 of FIG. 1.

A first pair of operating contacts 14, 16 is provided. Contact 14 is mounted on arm 12 and opposite facing contact 16 is mounted on a stationary member 18. Member 18 is fastened to housing 10 by a rivet 20 and is made of a metal material preferably brass. As best shown in FIGS. 1 and 2, member 18 has a horizontal portion 18*a*, a vertical portion 18*b* extending upwardly from the horizontal portion and a second horizontal portion 18*c* extending horizontally from the top of the vertical portion. The second horizontal portion 18*c* has a terminal 22 formed thereon and adapted for connection to an electrical conductor (not shown). Member 18 provides electrical connection between contact 16 and terminal 22. Contact 14 is biased downwardly into contact with contact 16 by spring arm 13.

A second pair of operating contact members 24, 26 is provided. Contact member 24 is mounted on arm 12 and oppositely facing contact 26 is mounted on a support member 28 which, in turn, is clamped to housing 10 by a metal strap member 30 having a terminal 32 formed thereon as shown in FIG. 2. Members 28 and 30 are made of metal material. Member 28 is preferably made of spring temper phosphor bronze and member 30 is preferably made of brass. Members 28 and 30 provide an electrical connection between the contact 26 and terminal 32 (see FIG. 2) which, in turn, is adapted for connection to an electrical conductor (now shown). Member 28 is flexible.

Figure 4:
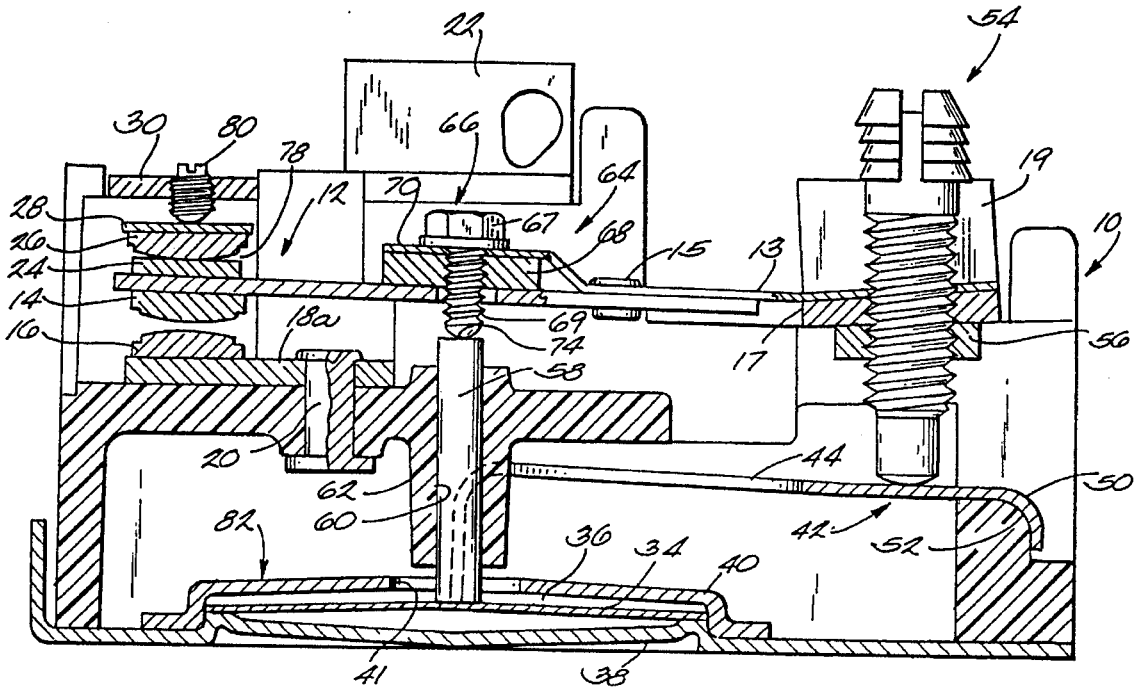
FIG. 4 is a side elevation view of the switch construction shown in FIG. 1 after the bi-metallic disk has been snapped upwardly to operate the switch.

A bi-metallic snap disk 34 of substantially circular configuration is mounted in the space 36 between a platform member 38 and a cup member 40. The construction details and functional advantages of the combination platform member 38 and cup member 40 are described in detail and claimed in co-pending application Ser. No. 08/303,118 filed Sep. 8, 1994. For purposes of this application, it is sufficient to state that disk 34 is free to snap within space 36 from its position shown in FIG. 1 to its position shown in FIG. 4.

Figure 6:
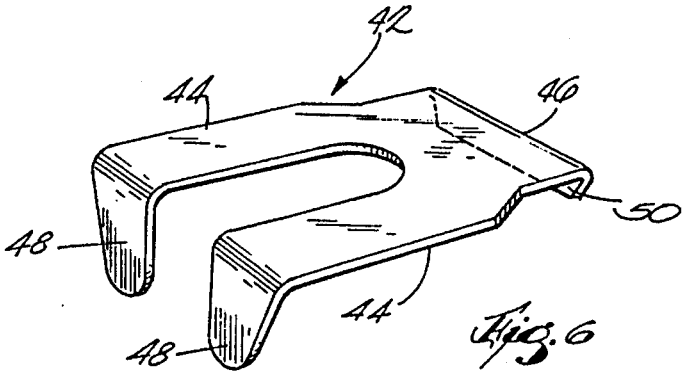
FIG. 6 is a perspective view of the spring member for adjusting the thermostat temperature setting.
Figure 7:
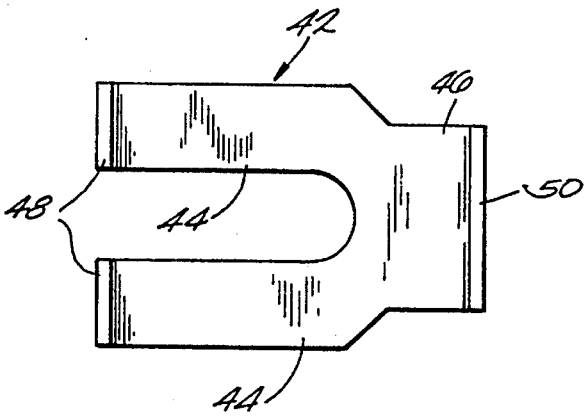
FIG. 7 is a top plan view of the spring member shown in FIG. 6.
Figure 8:
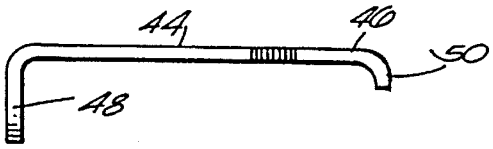
FIG. 8 is a side elevation view of the spring member shown in FIG. 7.

A one-piece temperature setting adjusting spring member 42 is provided. The configuration of spring member 42 is shown in FIGS. 6, 7 and 8. Member 42 has a pair of spaced arms 44, 44 extending from a support end portion 46. Arms 44, 44 have a pair of downwardly extending bi-metallic disk contacting fingers 48, 48. Support end 46 has a downwardly extending mounting lip 50.

Adjustment spring member 42 is mounted in the switch housing 10 as shown in FIG. 1. As shown, lip 50 rests on and is retained by a rounded support surface 52 formed in the housing 10. Contacting fingers 48, 48 extend through opening 41 in cup member 40 to thereby make contact with the upper face of disk 34.

The pressure exerted by contact fingers 48, 48 on disk 36 can be adjusted by threaded screw member 54 threadably mounted in a threaded collar 56 formed integrally with base portion 17 of terminal fitting 19.

The switch actuating plunger 58 is slidably mounted in an elongated opening 60 formed in cylindrical portion 62 of housing 10.

A "creep" gap set assembly 64 is provided. Assembly 64 is comprised of a creep set screw 66 having a threaded stem portion 69 and a head portion 67 on the end thereof. Set screw 66 is threadably mounted in a nut member 68 which, in turn, is fastened to the end portion 70 of spring arm 13. The threaded portion 69 of creep set screw 66 extends through an opening 71 in switch arm 12.

OPERATION

It is desirable that prior to use, a gap indicated by reference numeral 72 be set between the end 74 of plunger 58 and the end 76 of the threaded portion 69 of set screw 66. The desired gap 72 is set by following the steps as follows:

(a) Turn down creep set screw 66 until contacts 14, 16 open (this can be observed by using an indicator light and electrical source connected between terminal 22 and terminal 19, i.e., the light will go out when the contacts open), stop rotation immediately when opening is sensed;

(b) Back off set screw 66 a measured degree of rotation relative to screw pitch to provide the desire gap 72 as shown in FIG. 1.

(c) The pressure applied on disk 34 by spring member 42 is set by adjustment of threaded screw member 54.

The thermostat is now set for use.

In use, as the heat sensed by bi-metallic disk 34 reaches a predetermined degree, the disk will begin to move slowly upwardly causing the plunger 58 to slide upwardly in opening 60. With the proper settings of the creep set assembly 64 and temperature setting screw 54, disk 34 will snap over center just before the end 74 of plunger 58 makes contact with the end 67 of threaded portion 69 of set screw 66.

The upwardly actuated plunger 58 will cause it to hit the end 67 of the creep set screw which, in turn, will cause contacts 14, 16 to snap open and, at the same time, will cause contacts 24, 26 to snap close. The opening of contacts 14, 16 will interrupt the electrical circuit between terminals 22 and 19. The closing of contacts 24, 26 will closed the electrical circuit between terminals 32 and 19.

Figure 5:
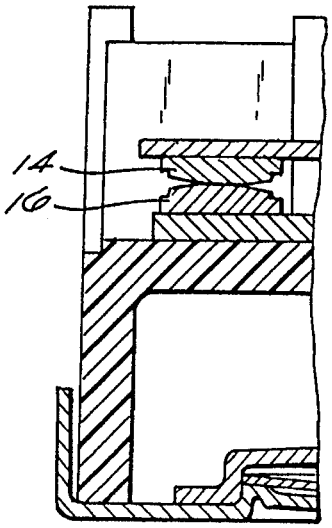
FIG. 5 is fragmentary view showing the switch contact arrangement in a single throw switch embodiment of the invention.

FIG. 5 shows an embodiment of the present invention in a single-throw switch, i.e., double-throw contacts 24, 26 are eliminated. In the double-throw embodiment (FIG. 1), the desired gap 78 between double-throw contacts 24, 26 can be set by adjustment of set screw 80. Set screw 80 is threaded into a threaded opening in member 30.

The desired gap 78 is set by following the steps as follows:

(a) Turn down gap set screw 80 until contacts 24, 26 close; (this can be observed by using an indicator light and electrical source connected between terminal 32 and terminal 19, i.e., the light will turn on when the contacts close); stop rotation immediately when closing is sensed.

(b) Back off set screw 80 a measured degree of rotation relative to screw pitch to provide the desired gap 78 as shown in FIG. 1. The feature that facilitates the contact support member 28 to back off and stay in contact with the end of the screw 80 is the flexibility and spring temper of support member 28.

While the invention has been herein shown and described in what is presently conceived to be the most practical and preferred embodiment, it will be obvious to one or ordinary skill in the art that many modifications may be made thereof within the scope of the invention, which scope is not to be limited except by the appended claims.

I claim:

1. A thermostatic switch construction comprising:

(a) a housing means (10);

(b) a switch arm means (12) mounted for movement in said housing;

(c) a bi-metallic snap disk means (34) mounted in said housing and movable with snap action between two positions of stability;

(d) a switch arm actuating plunger means (58) adapted for movement by said snap disk means;

(e) a creep gap set means (64), including a creep gap set screw (66) threadably mounted in said switch arm means opposite one end of said plunger means, the space between said set screw and said one end of said plunger being adjustable by rotation of said set screw.

2. A thermostatic switch construction according to claim 1 in which said switch arm means is anchored in said housing means and biased downwardly by a spring arm means (13).

3. A thermostatic switch construction according to claim 1 in which said creep gap set screw is threaded into a member (68) which in turn is fastened to said switch arm.

4. A thermostatic switch construction comprising:

(a) a housing means (10);

(b) a double throw switch arm means (12) mounted for movement in said housing and having a pair of contacts (14, 24) mounted on opposite sides of said switch arm means, said contact (14) movable relative to a stationary contact (16) to control an electric circuit and said contact (24) movable relative to a contact (26) to control an electric circuit;

(c) a bi-metallic snap disk means (34) mounted in said housing and movable with snap action between two positions of stability;

(d) a switch arm actuating plunger means (58) adapted for movement by said snap disk means;

(e) a creep gap set means (64), including a creep gap set screw (66) threadably mounted in said switch arm means opposite one end of said plunger means, the space between said set screw and said one end of said plunger being adjustable by rotation of said set screw.

5. A thermostatic switch construction according to claim 4 in which said switch arm means is anchored in said housing means and biased downwardly by a spring arm means (13).

6. A thermostatic switch construction according to claim 4 in which said creep gap set screw is threaded into a member (68) which in turn is fastened to said switch arm.

7. A thermostatic switch construction according to claim 4 in which contact (26) is mounted on a flexible support member (28), the gap between contacts (26) and (24) is adjustable by means of a adjustable screw member (80) threaded into a stationary support (30).

8. A thermostatic switch construction comprising:

(a) a housing means (10);

(b) a switch arm means (12) mounted for movement in said housing;

(c) a bi-metallic snap disk means (34) mounted in said housing and movable with snap action between two positions of stability;

(d) a switch arm actuating plunger means (58) adapted for movement by said snap disk means;

(e) a creep gap set means (64), including a creep gap set screw (66) threadably mounted in said switch arm means opposite one end of said plunger means, the space between said set screw and said one end of said plunger being adjustable by rotation of said set screw;

(f) a temperature setting adjustment means comprising a spring member (42) mounted in said housing, one end of said spring member is in contact with said bi-metallic disk to thereby exert pressure on said disk, and an adjustment screw threadably mounted in said housing with its end in contact with said spring member, said adjustment screw operable when rotated to adjust the degree of pressure applied to said disk by said spring.

9. A thermostatic switch construction comprising:

(a) a housing means (10);

(b) a switch arm means (12) mounted for movement in said housing;

(c) a bi-metallic snap disk means (34) mounted in said housing and movable with snap action between two positions of stability;

(d) a switch arm actuating plunger means (58) adapted for movement by said snap disk means;

(e) a temperature setting adjustment means comprising a spring member (42) mounted in said housing, one end of said spring member is in direct contact with said bi-metallic disk to thereby exert pressure on said disk, and an adjustment screw threadably mounted in said housing with its end in contact with said spring member, said adjustment screw operable when rotated to adjust the degree of pressure applied to said disk by said spring.

10. A thermostatic switch construction comprising:

(a) a housing means (10);

(b) a switch arm means (12) mounted for movement in said housing;

(c) a bi-metallic snap disk means (34) mounted in said housing and movable with snap action between two positions of stability;

(d) a switch arm actuating plunger means (58) adapted for movement by said snap disk means;

(e) a creep gap set means (64), including a creep gap set screw (66) threadably mounted in said switch arm means opposite one end of said plunger means, the space between said set screw and said one end of said plunger being adjustable by rotation of said set screw, said creep gap set screw is threaded into a member (68) which in turn is fastened to said switch arm, said member (68) is fastened to the top surface of said switch arm and said set screw extends through an opening in said switch arm.

11. A thermostatic switch construction comprising:

(a) a housing means (10);

(b) a double throw switch arm means (12) mounted for movement in said housing and having a pair of contacts (14, 24) mounted on opposite sides of said switch arm means, said contact (14) movable relative to a stationary contact (16) to control an electric circuit and said contact (24) movable relative to a contact (26) to control an electric circuit;

(c) a bi-metallic snap disk means (34) mounted in said housing and movable with snap action between two positions of stability;

(d) a switch arm actuating plunger means (58) adapted for movement by said snap disk means;

(e) a creep gap set means (64), including a creep gap set screw (66) threadably mounted in said switch arm means opposite one end of said plunger means, the space between said set screw and said one end of said plunger being adjustable by rotation of said set screw, said creep gap set screw is threaded into a member (68) which in turn is fastened to said switch arm, said member (68) is fastened to the top surface of said switch arm and said set screw extends through an opening in said switch arm.

12. A thermostatic switch construction comprising:

(a) a housing means (10);

(b) a switch arm means (12) mounted for movement in said housing;

(c) a bi-metallic snap disk means (34) mounted in said housing and movable with snap action between two positions of stability;

(d) a switch arm actuating plunger means (58) adapted for movement by said snap disk means;

(e) a creep gap set means (64), including a creep gap set screw (66) threadably mounted in said switch arm means opposite one end of said plunger means, the space between said set screw and said one end of said plunger being adjustable by rotation of said set screw;

(f) a temperature setting adjustment means comprising a spring member (42) mounted in said housing, one end of said spring member is in contact with said bi-metallic disk to thereby exert pressure on said disk, and an adjustment screw threadably mounted in said housing with its end in contact with said spring member, said adjustment screw operable when rotated to adjust the degree of pressure applied to said disk by said spring, said spring member (42) has a pair of spaced arms (44, 44) extending from a support end portion (46) and a pair of fingers (48, 48) on the other end of the spring member in direct contact with said disk means (34).

13. A thermostatic switch construction comprising:

(a) a housing means (10);

(b) a switch arm means (12) mounted for movement in said housing;

(c) a bi-metallic snap disk means (34) mounted in said housing and movable with snap action between two positions of stability;

(d) a switch arm actuating plunger means (58) adapted for movement by said snap disk means;

(e) a temperature setting adjustment means comprising a spring member (42) mounted in said housing, one end of said spring member is in contact with said bi-metallic disk to thereby exert pressure on said disk, and an adjustment screw threadably mounted in said housing with its end in contact with said spring member, said adjustment screw operable when rotated to adjust the degree of pressure applied to said disk by said spring, said spring member (42) has a pair of spaced arms (44, 44) extending from a support end portion (46) and a pair of fingers (48, 48) on the other end of the spring member in direct contact with said disk means (34).

* * * * *